US009272195B2

(12) United States Patent
Argiro et al.

(10) Patent No.: US 9,272,195 B2
(45) Date of Patent: Mar. 1, 2016

(54) SWING TRAINING DEVICE

(71) Applicant: Robert Argiro, Danville, CA (US)

(72) Inventors: Robert Argiro, Danville, CA (US); Beau Oyler, Oakland, CA (US); Yulian Bagirov, Oakland, CA (US); Janna Budge, Oakland, CA (US); Masao Yokota, Soquel, CA (US)

(73) Assignee: Robert Argiro, Castro Valley, CA (US)

( * ) Notice: Subject to any disclaimer, the term of this patent is extended or adjusted under 35 U.S.C. 154(b) by 0 days.

(21) Appl. No.: 14/607,818

(22) Filed: Jan. 28, 2015

(65) Prior Publication Data

US 2015/0231472 A1 Aug. 20, 2015

Related U.S. Application Data

(60) Provisional application No. 61/942,173, filed on Feb. 20, 2014.

(51) Int. Cl.
*A63B 69/00* (2006.01)

(52) U.S. Cl.
CPC ..... *A63B 69/0002* (2013.01); *A63B 69/0075* (2013.01); *A63B 2069/0008* (2013.01)

(58) Field of Classification Search
CPC ..... A63B 69/0075; A63B 69/0002
USPC ..... 473/417
See application file for complete search history.

(56) References Cited

U.S. PATENT DOCUMENTS

| | | | | |
|---|---|---|---|---|
| 5,704,656 | A * | 1/1998 | Rowe | F16L 5/02 285/139.3 |
| 6,221,407 | B1 * | 4/2001 | Gallart | A23G 3/50 426/103 |
| 7,169,067 | B2 | 1/2007 | Town | |
| 7,513,833 | B1 | 4/2009 | Town | |
| 7,887,441 | B1 * | 2/2011 | Archer | A63B 43/06 473/417 |
| 2005/0107180 | A1 | 5/2005 | Halleck et al. | |
| 2006/0019774 | A1 * | 1/2006 | Lin | A63B 69/0075 473/417 |
| 2012/0322586 | A1 * | 12/2012 | Mourouzis | A63B 9/002 473/419 |
| 2014/0162803 | A1 | 6/2014 | Carney et al. | |

* cited by examiner

*Primary Examiner* — Gene Kim
*Assistant Examiner* — Jeffrey Vanderveen
(74) *Attorney, Agent, or Firm* — Beyer Law Group LLP

(57) ABSTRACT

A variety of swing training devices that are arranged to support a ball to be struck are described. At least one moveable object is positioned within a chamber located adjacent the ball support. The moveable object is arranged such that it can be seen by a hitter after the ball is struck when the hitter is looking at a point of contact where the ball is struck. The moveable objects are arranged to move when the ball is stuck and a variety of challenge games can be played that require the batter to identify something that happened to the moveable objects—thereby providing motivation to encourage the batter to focus his or her eyes on the region of contact.

10 Claims, 18 Drawing Sheets

SWING TRAINING DEVICE

CROSS REFERENCE TO RELATED APPLICATIONS

This application claims the priority of U.S. Provisional Patent Application No. 61/942,173, filed Feb. 20, 2014, which is incorporated herein by reference.

FIELD

The present invention relates generally to swing training devices such as tees and/or tee attachments suitable for use in batting practice and other swing training exercises.

BACKGROUND

In the game of baseball, a common mistake that batters make is the tendency to "pull their head" while swinging at a pitch. That is, the tendency to turn their head during a swing in a way such that they aren't looking at the point of contact between the bat and the ball. Such rotation of the head tends to cause undesirable rotation of the body and interfere with swing mechanics thereby adversely impacting the hitter's ability to consistently strike the ball with power. (Similar problems are observed in a wide variety of other sports where a bat, club, racket, etc. is used to strike a ball). Over the years, a wide variety of drills and props have been developed to help teach players improved swing mechanics. Although existing drills and props work well, there are continuing efforts to develop additional techniques and devices that can help improve swing mechanics.

The present inventors have developed a variety of tee attachments that can be used in various drills to help hitters/players improve their swing mechanics in part by motivating the player to keep their eye focus in the area of the point of contact during a swing. Several representative embodiments are illustrated in the accompanying drawings and described in more detail below.

SUMMARY

A variety of swing training devices that are arranged to support a ball to be struck are described. At least one moveable object is positioned within a chamber located adjacent the ball support. The moveable object is arranged such that it can be seen by a hitter after the ball is struck when the hitter is looking at a point of contact where the ball is struck. The moveable objects are arranged to move when the ball is stuck and a variety of challenge games can be played that require the batter to identify something that happened to the moveable objects—thereby providing motivation to encourage the batter to focus his or her eyes on the region of contact.

In some embodiments, the swing training device has a ball support surface that is positioned above and spaced apart from the chamber floor that supports the moveable objects. At least a portion of the chamber walls and/or ball support surface are substantially transparent such that a hitter using the swing training device can see inside the chamber after the ball has been hit.

In some described embodiments, the swing training device takes the form of a tee attachment arranged to be placed on a tee poet to support the ball to be struck. In one embodiment, the device includes a sleeve that extends downward from the chamber, with the sleeve being arranged to be placed over the tee post. A clamp may be used to secure the sleeve directly or indirectly to the tee post.

In some specific embodiments, the swing training device includes an outer member or main body arranged to be positioned over an inner member. The main body includes the ball support surface and an outer sleeve that extends downward from the ball support surface. The inner member includes an object support surface and an inner sleeve that extends downward from the object support surface. The outer member is arranged to be positioned over the inner member such that the ball support surface is positioned above and spaced apart from the object support surface in a manner that defines a chamber in a region between the ball support surface and the object support surface, the object support surface thereby serving as a chamber floor. At least a portion of the main body is substantially transparent such that a hitter using the swing training device can see inside the chamber.

The inner and outer sleeves may each include a pair of vertically extending slots. The inner sleeve slots facilitate placing the inner sleeve over a tee post. The outer sleeve slots facilitate placing the outer sleeve over the inner sleeve. One or more clamps may be provided to secure the swing training device to the tee post. When desired, a clamp cover can be provided to cover the clamp(s).

The moveable object(s) may take a wide variety of different forms. By way of example, disk-shaped, coin-shaped, cubic and various other regular polyhedral shapes are expected to be popular. In some embodiments, one or more structures may be provided on the chamber floor to enhance flipping movement of the moveable object(s) within the chamber.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION OF THE PREFERRED EMBODIMENTS

The present invention relates generally to swing training devices such as tees or tee attachments suitable for use in batting practice and other swing training exercises. In general, one or more moveable objects (e.g., dice, chips, balls, etc.) are built into a device that holds the ball (or other object) to be hit. The moveable objects provide a region for a batter to focus on as the ball is struck during swing training (e.g., batting practice).

Figure 1:
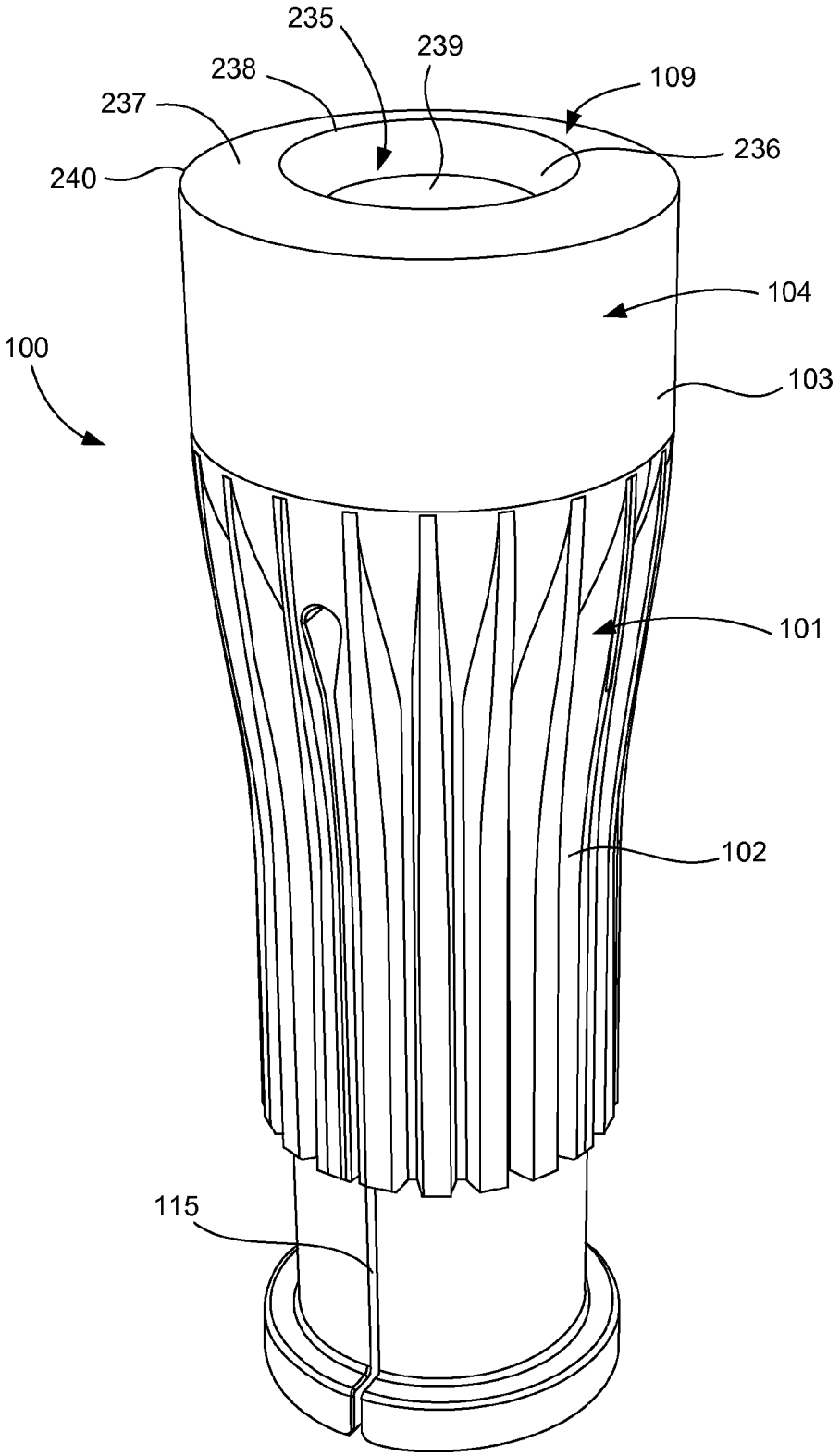
FIG. 1 is a perspective view of a tee attachment in accordance with one embodiment of the present invention.
Figure 2A:
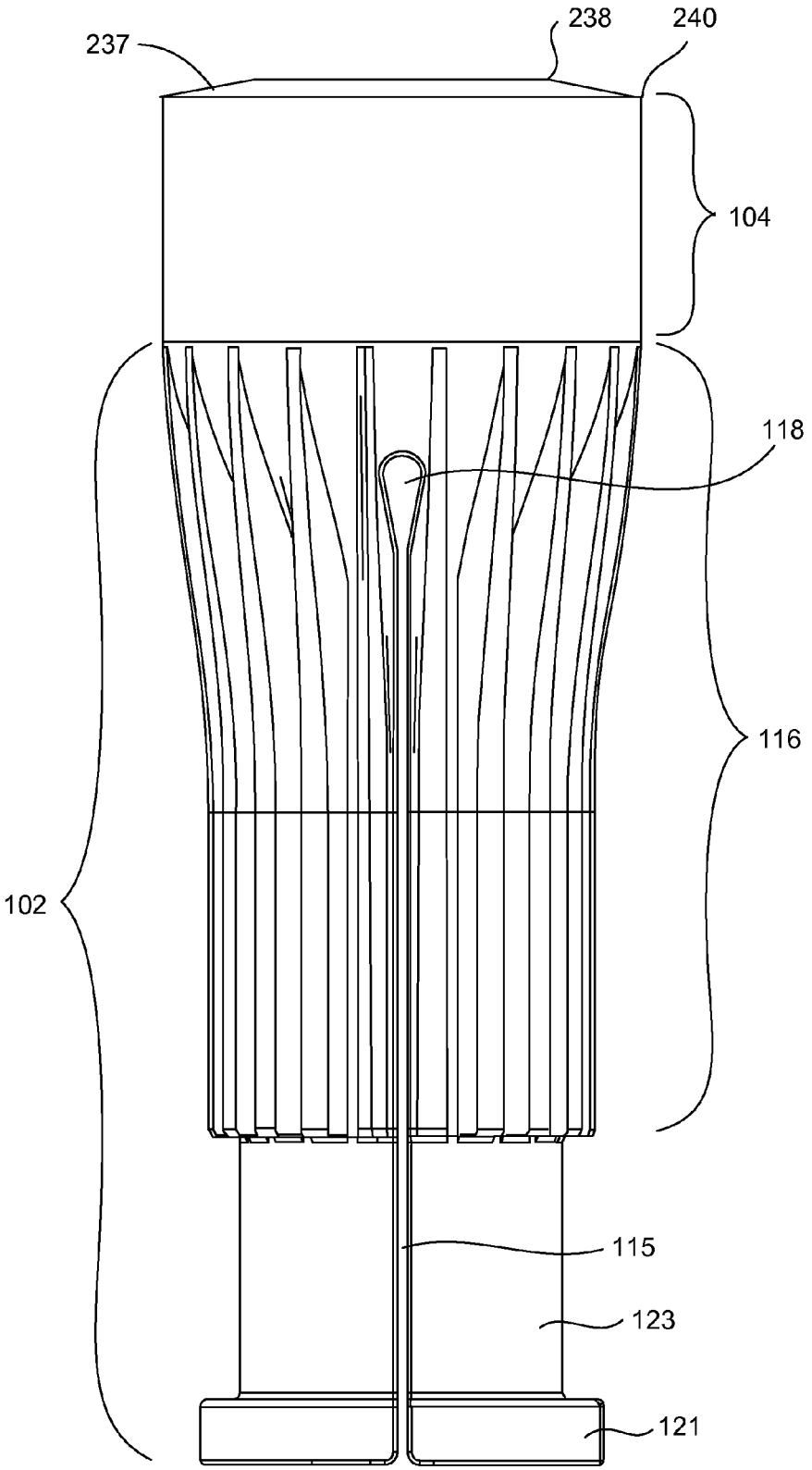
FIG. 2A is a side view of the tee attachment of FIG. 1.
Figure 2B:
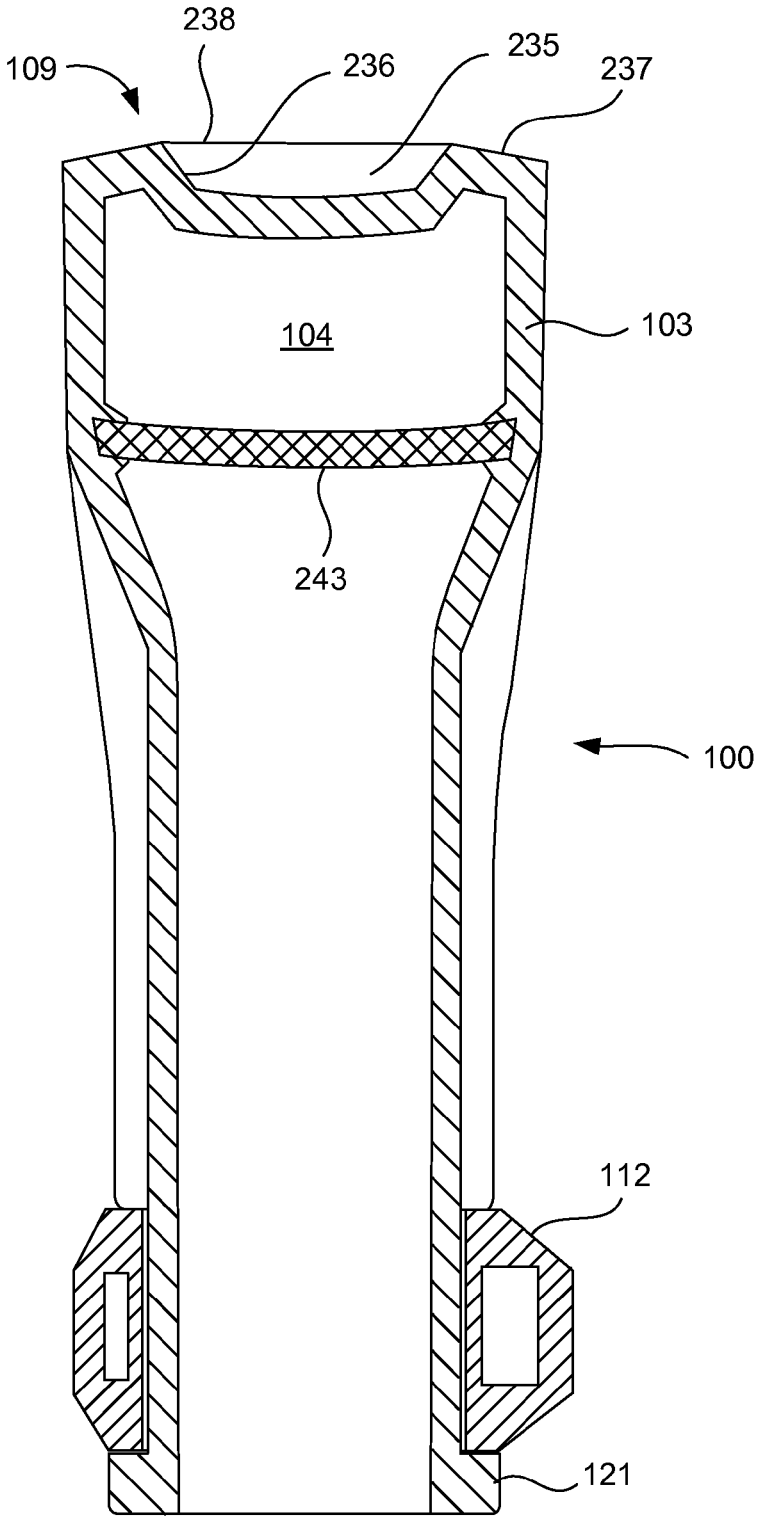
FIG. 2B is a cross sectional side view of the tee attachment of FIG. 1.
Figure 2C:
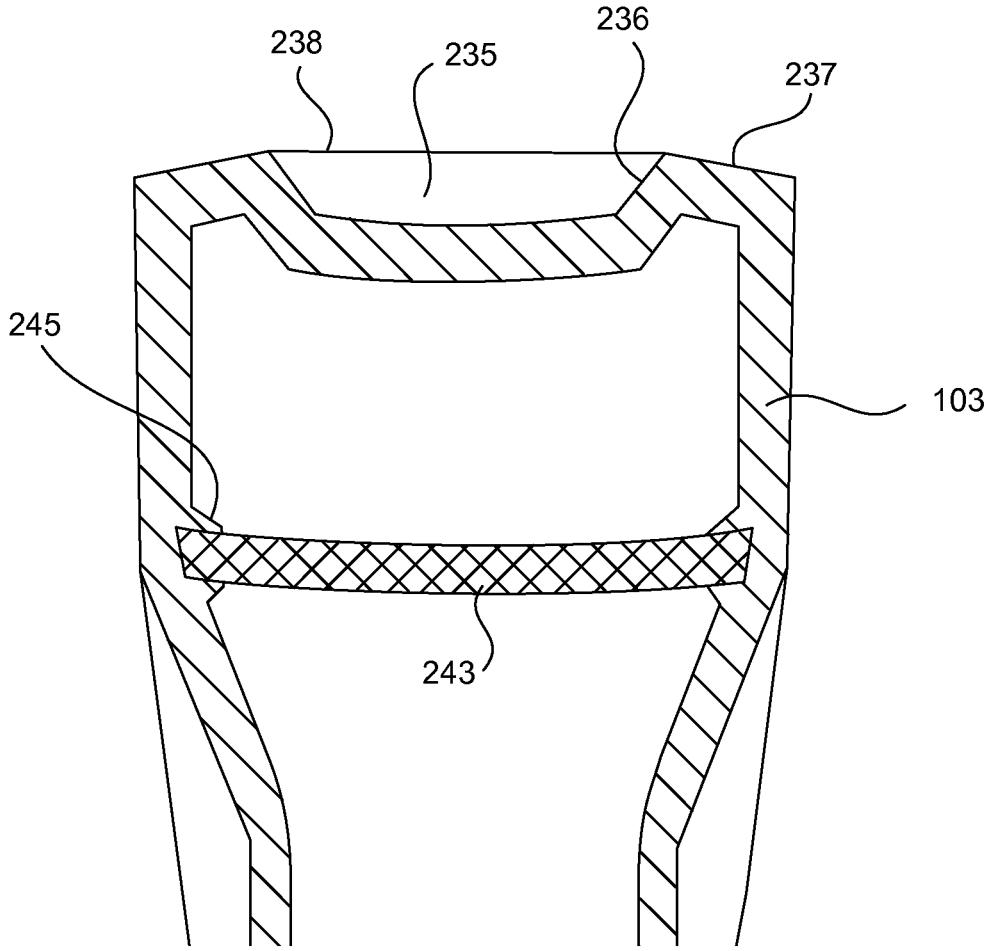
FIG. 2C is a cross sectional side view of the upper portion of the tee attachment of FIG. 1 highlighting the support of the chamber floor.
Figure 3:
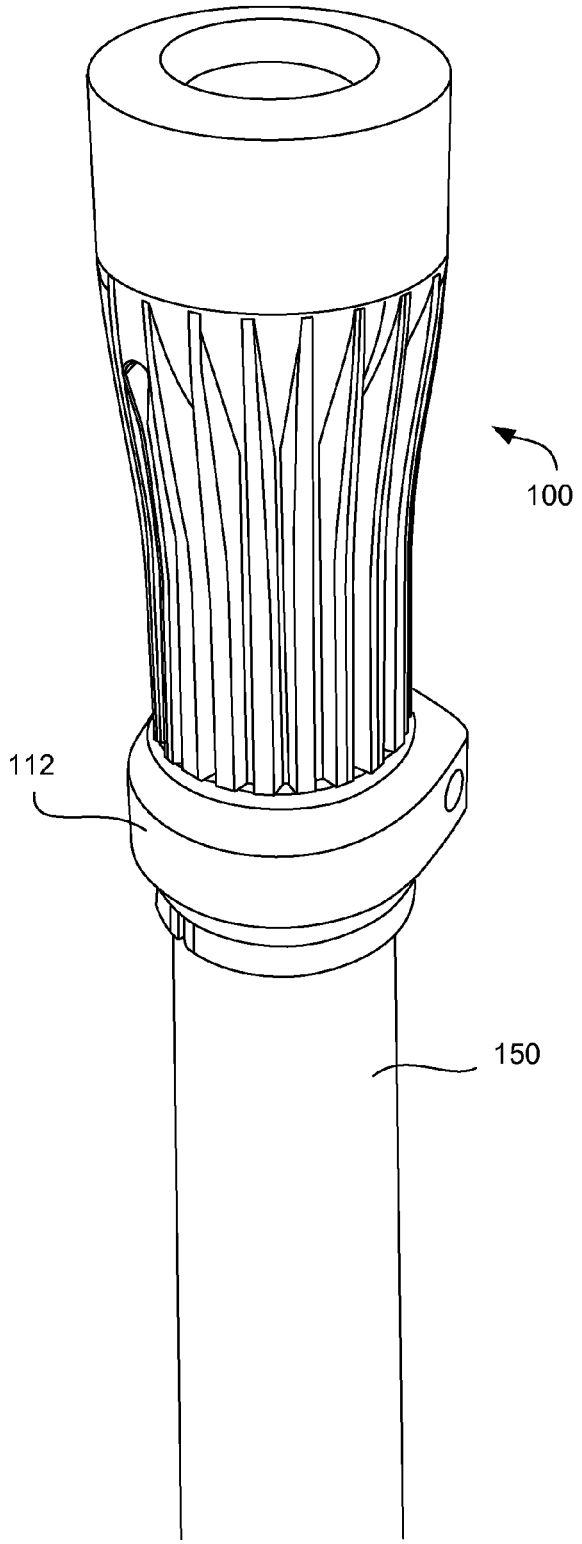
FIG. 3 is a perspective view of the tee attachment of FIG. 1 mounted on a tee post.

The embodiment illustrated in FIGS. 1 and 2A-2C takes the form of a tee attachment 100 that may be secured to the top (free) end of a batting tee post 150 as best illustrated in FIG. 3. The tee attachment 100 has a main body 101 that includes a sleeve 102, a chamber wall 103 and a ball support 109. The chamber wall 103 is annular and encloses a chamber 104. A clamp assembly 112 (see FIG. 3) is also provided to secure the tee attachment to the tee post. The sleeve 102 has a pair of slits 115 on opposing sides and is arranged to slide over the top of a batting tee post 150 (see FIG. 3) such that the chamber 104 is supported at/by the top of the tee post 150. Clamp assembly 112 (which may include a hose clamp) secures the tee attachment 100 to the tee post 150.

In the assembled position on a batting tee, the ball support 109 is the uppermost portion of the tee attachment. The ball support 109 has a recess 235 surrounded by a rim 237. The junction of the recess and the rim forms a ball support ring 238. The recess 235 is arranged to support a ball (e.g., a baseball or a softball) in a stable position suitable for hitting much like a conventional tee. The walls 236 of recess 235 may be tapered inward as they descend from the support ring 238 towards the bottom 239 of the recess. The taper of the recess walls and the depth of the recess 235 are preferably sufficient such that a supported ball will not contact the recess wall significantly below the rim or contact the bottom of the recess. The rim is slightly angled (tapered) radially outward from the support ring 238 such that the ball support ring 238 is a bit higher than the outer circumference 240 of the rim 237. This rim taper helps the ball come out with a good trajectory when a ball is hit off of the tee attachment (e.g., the ball is less likely to pop up into the air due to catching an edge when coming off of the tee). The bottom part 239 of the recess (which cannot be seen when a ball is supported by the tee attachment), has a multiplicity of small holes that extend into the chamber 104 to help prevent the enclosed area from getting condensation and/or fogging up. The circumference of the support ring 238 is selected so that the ball support can hold the ball in a good position for hitting.

The chamber 104 is bounded by an annular chamber wall 103 to the sides, chamber floor 243 on the bottom and ball support 109 at the top as best seen in FIGS. 2B and 2C. The ball support 109 and the chamber wall 103 are preferably substantially clear so that the batter can see objects positioned within the chamber. As will be described in more detail below, moveable objects (such as dice) are positioned within the chamber 104. These objects are intended to provide a focal point for the batter after the ball is struck to give the batter incentive to keep his/her eyes on the point of contact during the swing. For example, in some embodiments, dice having different colored surfaces may be placed in the chamber. When a hitter strikes the ball, the tee will move causing movement of the dice. A game may then be played that requires the hitter to focus on the dice after the ball is struck In one example, the hitter may be asked to call out something that the dice do after the ball is hit (e.g., call out which die stops last, what colors are shown, etc.). Such a game gives hitters incentive to keep their eyes down at the point of contact during a swing and provides visual feedback when that is accomplished.

Figure 4:
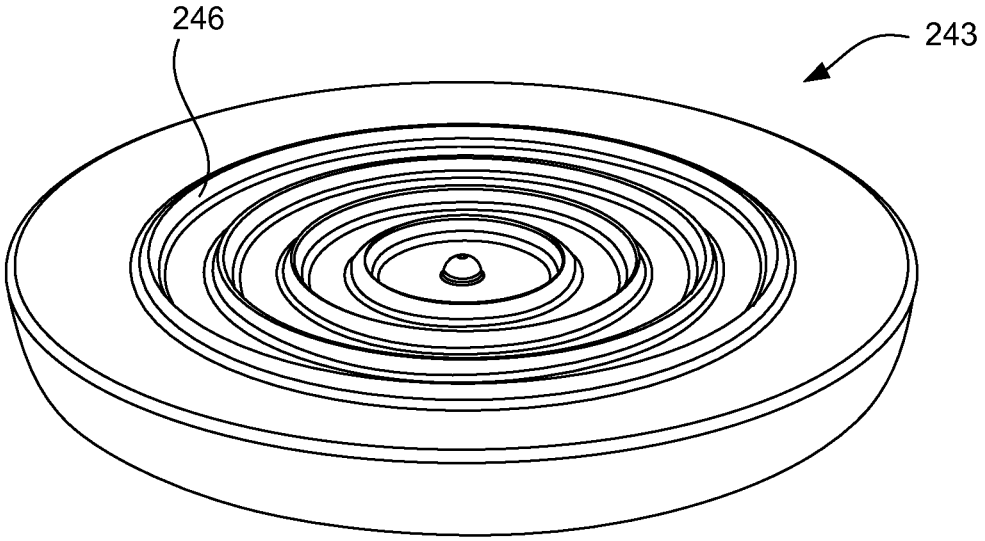
FIG. 4 is a perspective view of a chamber floor having concentric ridges suitable for use in the tee attachment of FIG. 1.
Figure 5:
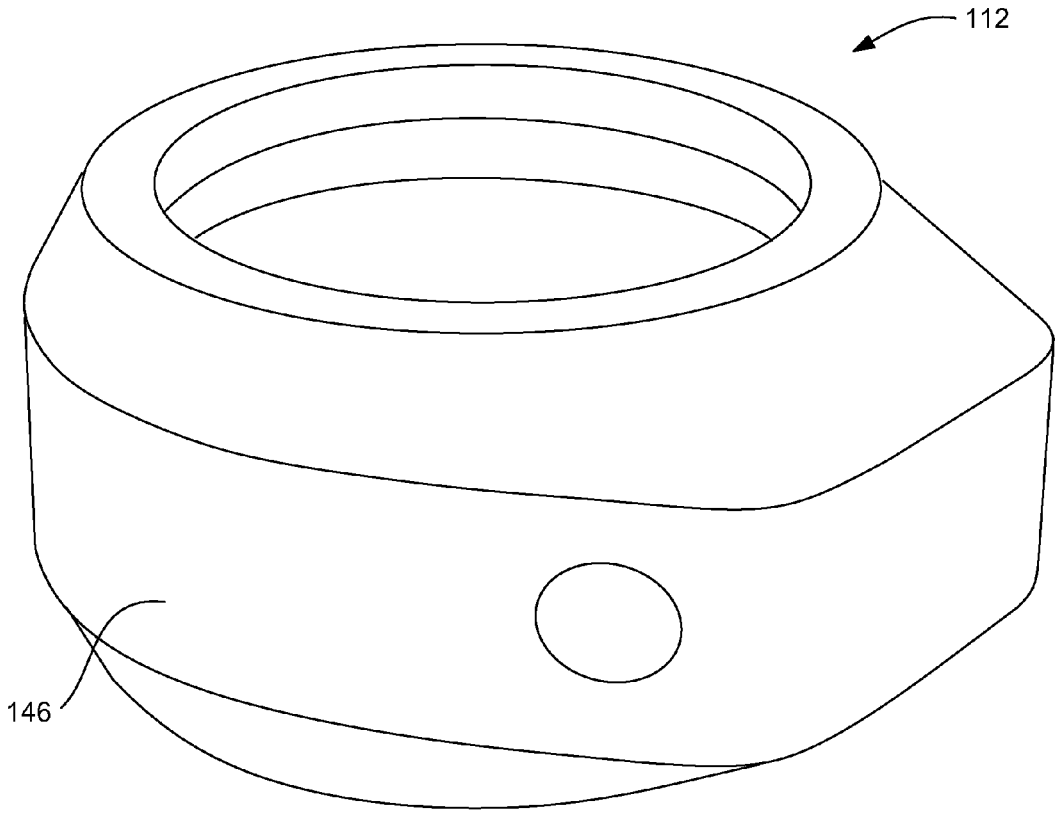
FIG. 5 is a perspective view of a clamp assembly suitable for securing the tee attachment of FIG. 1 to at tee post.
Figure 6:
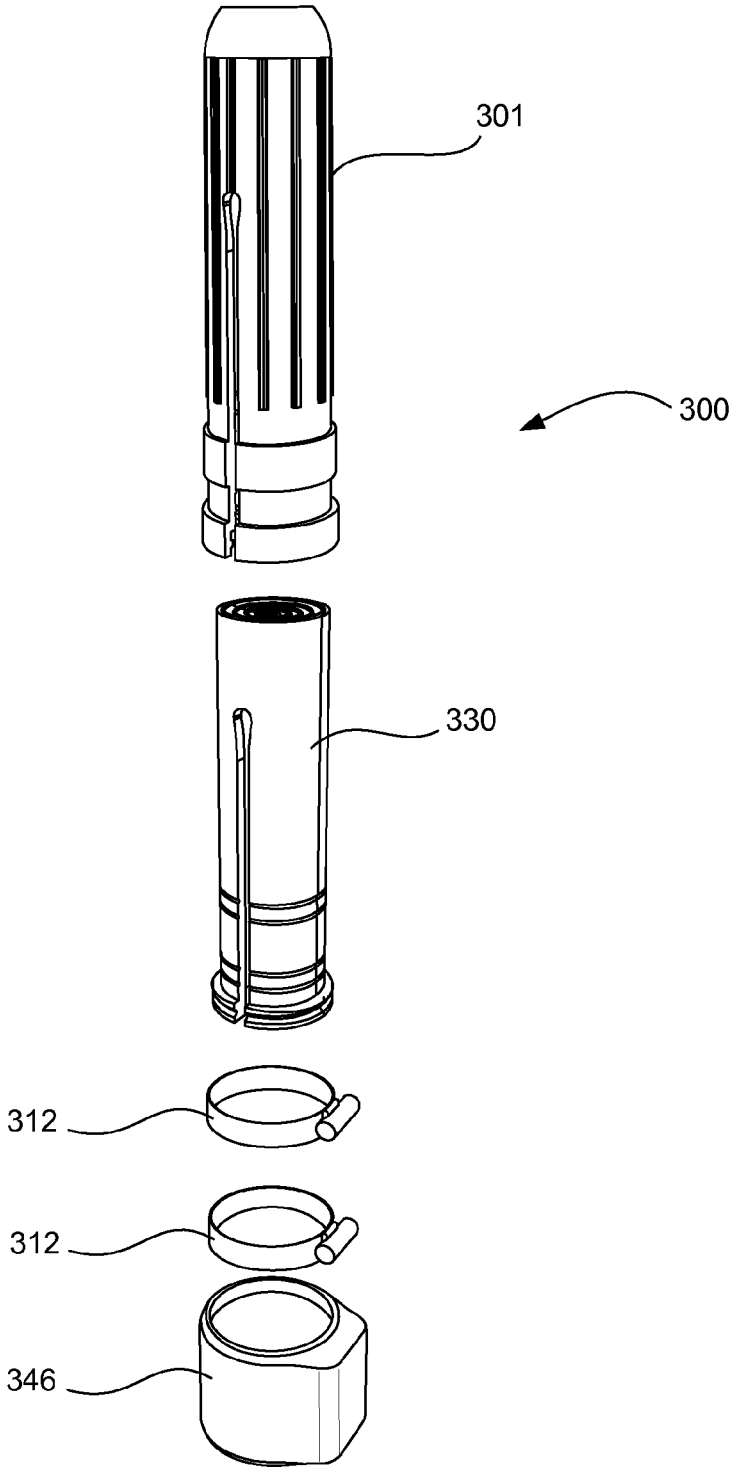
FIG. 6 is an exploded perspective view of an alternative tee attachment design.

In the illustrated embodiment, the chamber floor 243 is held in an annular groove in the main body 101 located at the bottom of the chamber wall 103. The groove may be recessed into the chamber wall, or formed from annular ledges 245 that extend outward from the main body as shown in FIG. 2C. In other embodiments, the chamber floor may be formed or supported in any other suitable manner. The chamber floor 243 may optionally have a variety of structures designed to increase the activity of the objects inside the enclosed area once a ball is hit off of the tee. FIG. 4 is a perspective view of one suitable floor pattern. In the illustrated embodiment, the floor has a series of small concentric ridges 246 that help flip (or otherwise alter the position of) the dice as they move within the chamber 104 after a ball is struck. Of course, in other embodiments a wide variety of alternative floor structures may be used and different types of floor structures may be suitable for use in conjunction with different types of moveable objects.

The sleeve portion 102 of main body 101 has a plurality of ribs 117 that form a corrugated section 116 which helps increase the durability of the product. The ribs/corrugations act as a kind of shock absorber. Slits 115 in the sleeve 102 provide flexibility so that the tee attachment can fit easily over a variety of tees. The slit 115 has a teardrop shape 118 at its upper (top) end to alleviate the stress on the top of the slit, which helps prevent tearing and further improves durability.

The lower end of the sleeve 102 has a bottom flange 121 and a smooth (uncorrugated) clamp support surface 123 just above the bottom flange 121. The clamp assembly 112 is arranged to be secured about the sleeve at the clamp support surface in order to secure the tee attachment to a tee. The upper and lower ends of the clamp support surface 123 are bounded by the corrugations 116 and the flange 121 which protrude radially outward relative to the clamp support surface to prevent the tightened clamp from sliding up or down relative to the sleeve 102. In the illustrated embodiment, the clamp 112 includes a hose clamp (not shown) and a clamp protector 146 that surrounds and protects the hose clamp from being directly hit by a bat during use. Thus, the clamp protector 146 serves to protect both the clamp and the bat. The clamp protector may be formed from any suitable material. By way of example, high impact resistant urethane, polyurethane or silicone works well. The illustrated clamp protector is preferably sized to fit within the clamp support recess defined between the corrugations 116 and the flange 121.

In the illustrated embodiment, the outer diameter of the main body 101 is generally wider at the chamber than at the sleeve although this is not a requirement. The top portion of the sleeve near the chamber wall 103 splays outward to form a smooth transition from the chamber wall to the corrugated sleeve. The inner diameter of the sleeve is generally constant, although again, there is some splaying outward at the upper end near the chamber wall. The interior diameter of the sleeve is selected so that the tee attachment 100 can fit onto a wide variety of tees. In other embodiments, the external diameter at the chamber 104 may be substantially the same, narrower, or tapered inward or outward relative to the sleeve diameter.

As suggested above, the dimensions of the tee attachment may vary significantly. In practice, the actual dimensions of the tee attachment may vary with the type of tees that the attachment is intended to be used with, the type of ball intended to be supported, various other design considerations etc. By way of example, in one specific embodiment, an overall attachment height of about 210 mm, a sleeve height of about 170 mm, an inner chamber diameter of about 61 mm, a natural inner diameter on the order of 40 mm, an inner diameter at the floor support lips of about 53 mm (such that the annular ledges 245 extend radially inward about 4 mm from the chamber wall), a sleeve thickness of about 4 mm in the narrow sections and 10 mm at the wider sections (e.g., the thickness at the ribs 117 and lip 121), works well.

In the preferred embodiment, the tee attachment is formed from a high impact resistant urethane, polyurethane or silicone. The various parts may be injection molded or formed using any other suitable process.

As suggested above, a wide variety of different objects can be placed in the chamber 104. By way of example, one or more dice, chips, and/or balls work well. Other suitable moveable objects may include: (a) objects with one or more sides of any shape, size and/or color; (b) granular objects such as sand, etc.; (c) glitter type objects; (d) confetti type objects, which may be formed from any suitable material including paper, plastic, rubber, liquid; or (e) a snow globe type object where a material is stirred up within a liquid. The purpose of the objects in the chamber is to provide an area immediately adjacent to the ball for the hitter to focus on when swinging through the point of contact. The object(s) are jolted when the ball is struck so that they move and potentially change orientations. As such, a game can be played in which the hitter is asked to call out or otherwise identify something that happened with respect to the object(s) after hitting the ball supported by the tee. The object(s) can have colors, numbers, symbols, geometries, etc. that can be used to give visual feedback to the hitter that he kept his eyes/head looking at the point at which contact occurred between the bat and the ball. The hitter then sees and may verbally say what he sees (color, number, symbols, etc).

Figure 14:
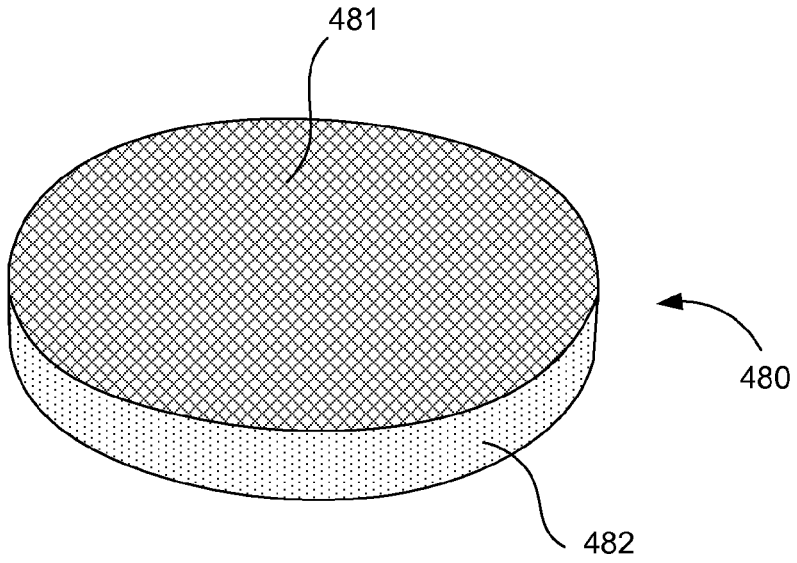
FIG. 14 is a perspective view showing a coin shape moveable object suitable for use in conjunction with the present invention.
Figure 15:
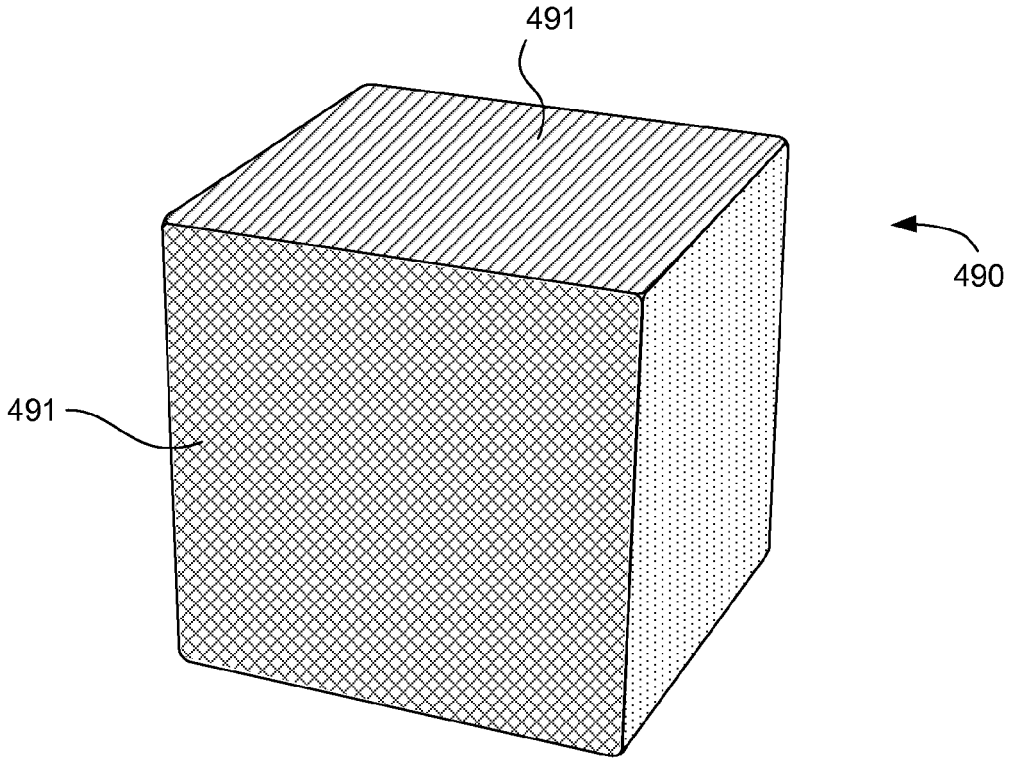
FIG. 15 is a perspective view showing a die shape moveable object suitable for use in conjunction with the present invention.

By way of example, FIG. 14 illustrates a coin or disc shaped moveable object 480. In some embodiments opposing sides 481, 482 of the coin 480 are colored different colors. FIG. 15 illustrates a cubic die shaped moveable object 490 in which all six sides 491 of the die 490 are painted different colors. With this arrangement, a game can be played in which the batter using the swing training device calls out the color that is facing upward after striking the ball supported by the device. This gives batters an incentive to keep their eyes focused on the area of contact after contact is made with the ball. As the batter becomes more experienced, this simple task of identifying the top color may become too easy to provide the needed incentive. In such circumstances more challenging games can be used. For example, multiple moveable objects can be introduced into the chamber and the batter can be asked to identify the status of all of the objects. Different numbers, letters, symbols, patterns or other markings may be placed on the surfaces instead of different colors. In some circumstances these other markings may be more challenging to identify, thereby increasing the incentive to focus on the region of contact. Of course a wide variety of other questions or challenge games that utilize moveable objects within the chamber can be devised in an effort to facilitate continued use and training.

As previously noted, the moveable objects may take a wide variety of different forms. In addition to the disc and cubic die shapes illustrated, a variety of other die shapes such as other regular polyhedrons may be used and are likely to be popular.

Referring next to FIGS. 6-10 another tee attachment embodiment will be described. In this embodiment, the tee attachment 300 includes a main body 301, an inner sleeve 330, a pair of clamps 312 and a clamp protector 346. The main body 301 includes a generally tubular outer sleeve portion 302 that can be slid over the inner sleeve 330, which in turn is arranged to slide over the top of a tee post similarly to the previously described embodiment. The upper end of the main body 301 is rounded somewhat such that it generally tapers radially inward towards ball support 309 which is formed at the top of the main body.

Figure 8:
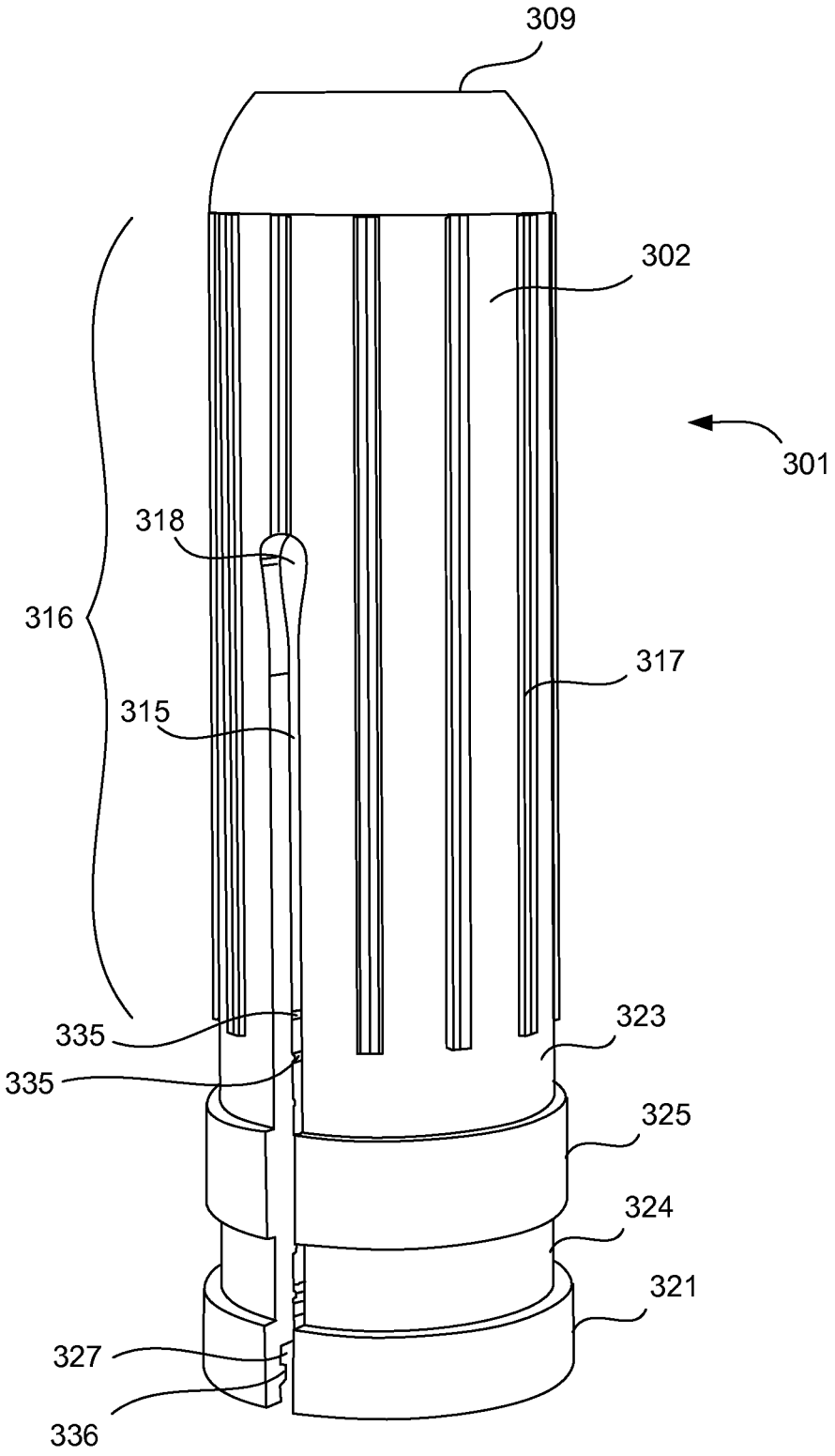
FIG. 8 is a perspective view of the main body of the tee attachment of FIG. 6.
Figure 9:
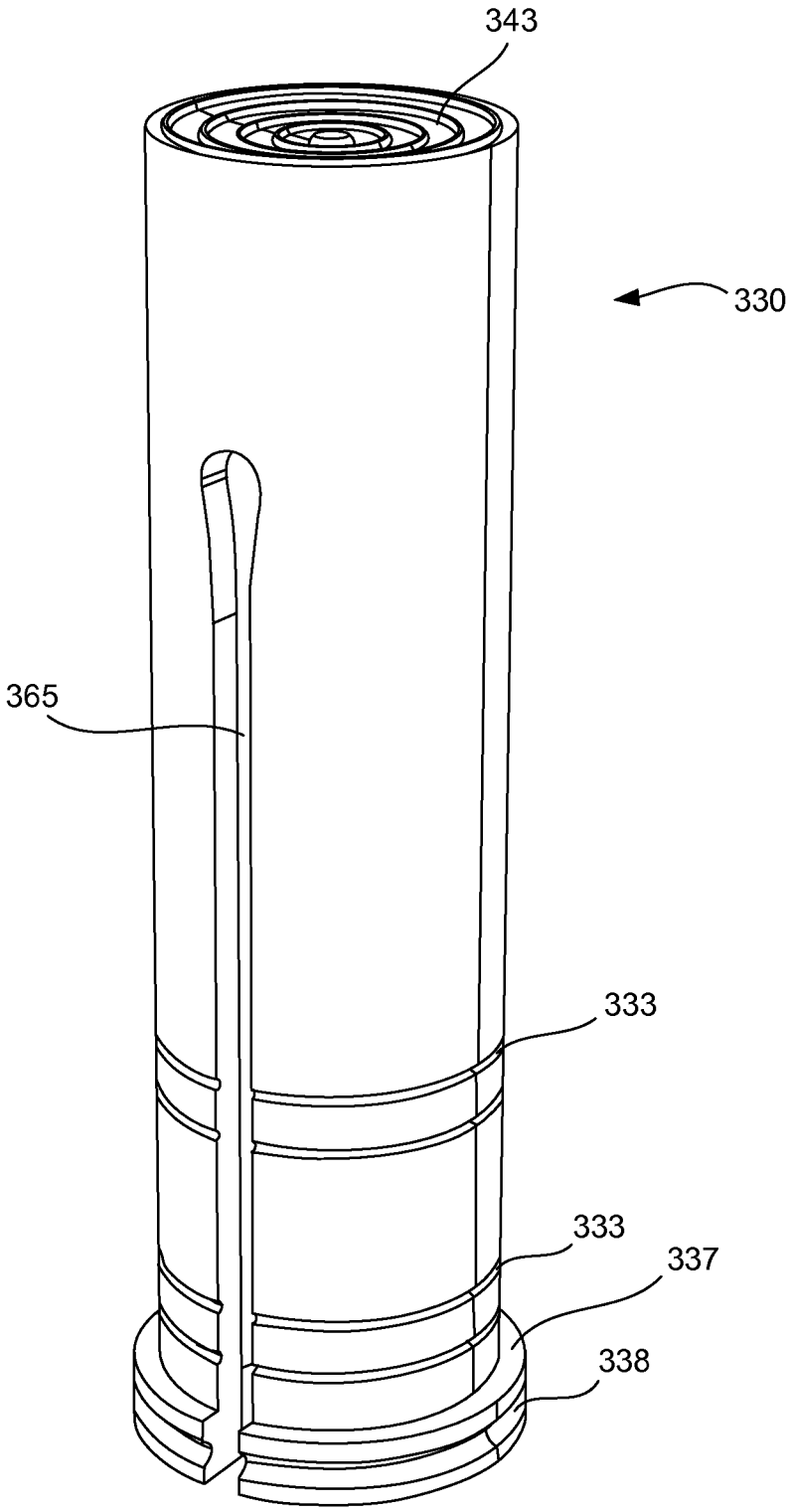
FIG. 9 is a perspective view of the inner sleeve of the tee attachment of FIG. 6.

As best seen in FIG. 8, the outer sleeve portion 302 has a pair of slits 315, ribs 317 that form a corrugated section 316, a pair of clamp support surfaces 323, 324 that are separated by an annular boss 325 and a lower flange 321. The lower clamp support surface 324 is located in an annular groove formed between the boss 325 and bottom flange 321. The upper clamp support surface 323 is located in an apparent groove between the bottom ends of ribs 317 and boss 325. Thus, both clamp support surfaces appear recessed relative to surrounding structures. The recessed clamp support surfaces effectively form clamp support channels that are sized appropriately to receive hose clamps 312. Slits 315 are teardrop shaped at their upper (top) ends and are much like the slits 115 in the previously described sleeve 102.

Figure 7A:
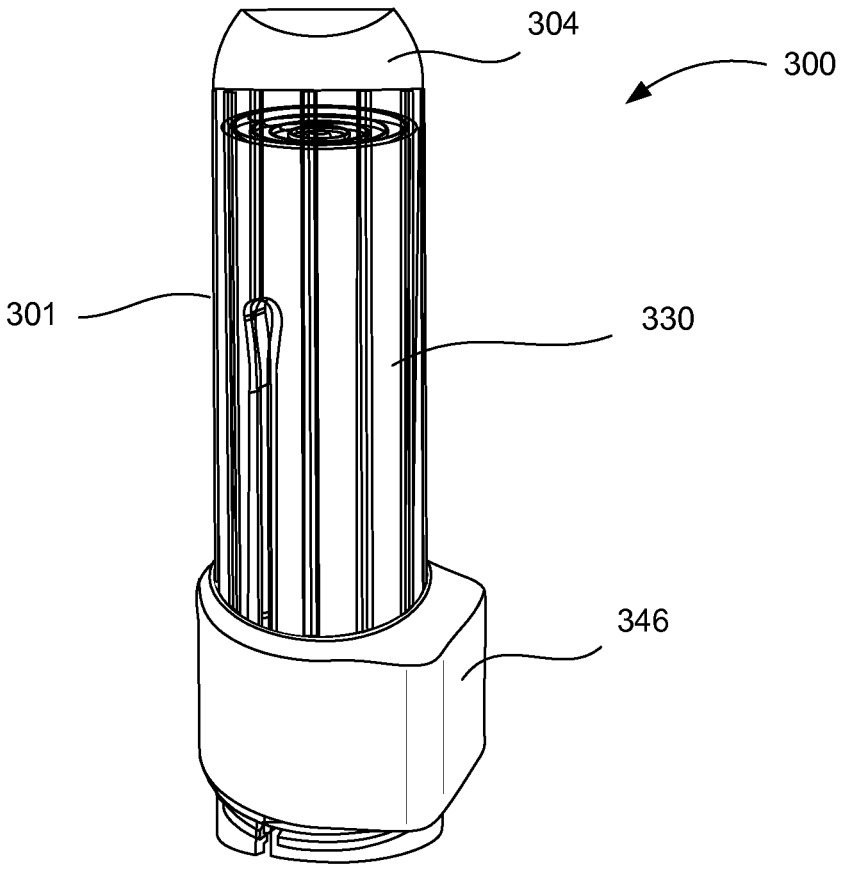
FIG. 7A is a perspective view of an assembled version of the tee attachment of FIG. 6.
Figure 7B:
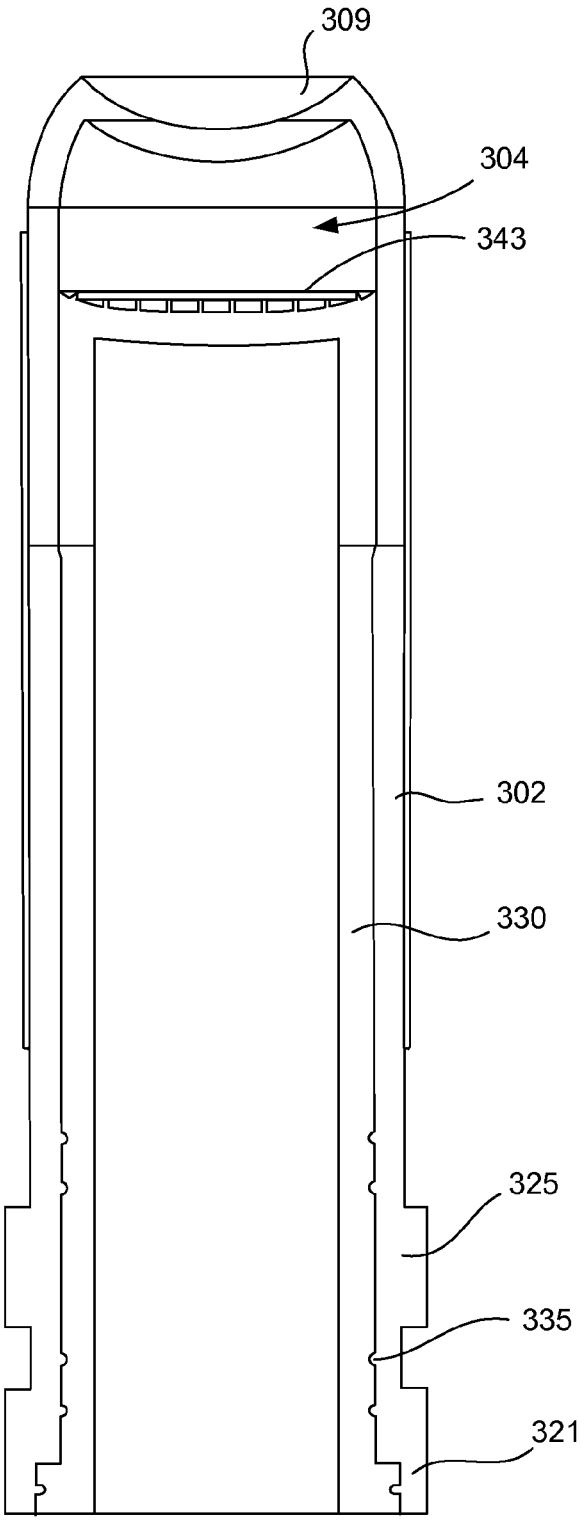
FIG. 7B is a cross sectional view of the assembled tee attachment of FIG. 7A.

As best seen in FIGS. 7B and 8, the radially inner surface of the sleeve portion 302 of main body 301 has a number of substantially annular, inward protruding ridges/ribs 335, 336 that are arranged to mate with corresponding annular grooves on the inner sleeve 330 to help hold the main body 301 and the inner sleeve in place relative to one another. In the illustrated embodiment, a pair of ribs 335 are positioned opposite each clamp support surface 323, 324. The radially inner surface of the main body sleeve also includes a recessed step 327 on the radially inner surface of flange 321. A relatively larger annular ridge/rib 336 protrudes inward from the stepped region 327.

The inner sleeve 330 is also generally tubular, although its top end is closed to form an object support surface that serves as the chamber floor 343 when the tee attachment is fully assembled as best illustrated in FIGS. 7A and 7B. Like the main body 301, the inner sleeve 330 has a pair of opposing, longitudinally extended slits 365 that allow it to be expanded sufficiently to readily slide into position over a tee post.

Several annular grooves 333 are provided on the outer surface of inner sleeve 330. The grooves 333 are arranged to mate with corresponding annular ribs 335 on the inner surface of main body 301 to form a locking structure that helps holds the main body 301 in place during use. The ribs 335 are positioned right under (radially inside) the clamp channels so that when the tee attachment is clamped into place on a tee post, the clamps 312 push the ribs 335 into the grooves 333 on the inner sleeve, thereby helping lock the inner sleeve and main body together to help prevent slippage between these two components.

The lower end of inner sleeve 330 has a flange 337 having an annular groove 338 on its radially outer surface. The flange 337 is arranged to fit in step 327 on the inner surface of the main body adjacent flange 321. Annular rib 336 projects radially inward from the step 327 and is arranged to engage the groove 338 on inner sleeve flange 337. It should be appreciated that both: (a) the inner sleeve flange/main body step 327; and (b) the rib 336/groove 338 cooperatively form additional locking structures that help hold the main body 301 in place relative to inner sleeve 330. In other embodiments the positions of the ribs and grooves may be reversed and/or other suitable locking structures may be used in their place.

The inner sleeve 330 is preferably formed from a material that has a relatively higher coefficient of friction (i.e., is not slick) relative to the tee post. By way of example, vulcanized rubber works well. The inner sleeve thus helps hold the tee attachment in place when the tee attachment is inadvertently struck during swing training. It has been found that such an arrangement is less likely to slip during use than the embodiment of FIG. 1 when the main body is made out of high impact resistant urethane, polyurethane or silicone.

When assembled, the main body 301 is slid over the inner sleeve 330 as best seen in FIG. 7. A chamber 304 is formed within the outer sleeve, with its upper boundary being defined by the lower surface of the ball support 309, its sides being defined by the inside walls of the upper end of outer sleeve portion 302 and its lower surface being defined by the closed end of the inner sleeve which thereby serves as floor 343. As in the previously described embodiments, moveable objects such as dice, etc. may be placed in the chamber 304 to facilitate swing training. Further, the floor 343 may have structures arranged to increase the activity of objects inside the chamber as previously described. The movement enhancing structures may take a wide variety of different forms, including concentric ridges much like the floor structure illustrated in FIG. 6, the structures described below with respect to FIGS. 12 and 13 or any of a wide variety of other angular motion enhancing structures.

Figure 10:
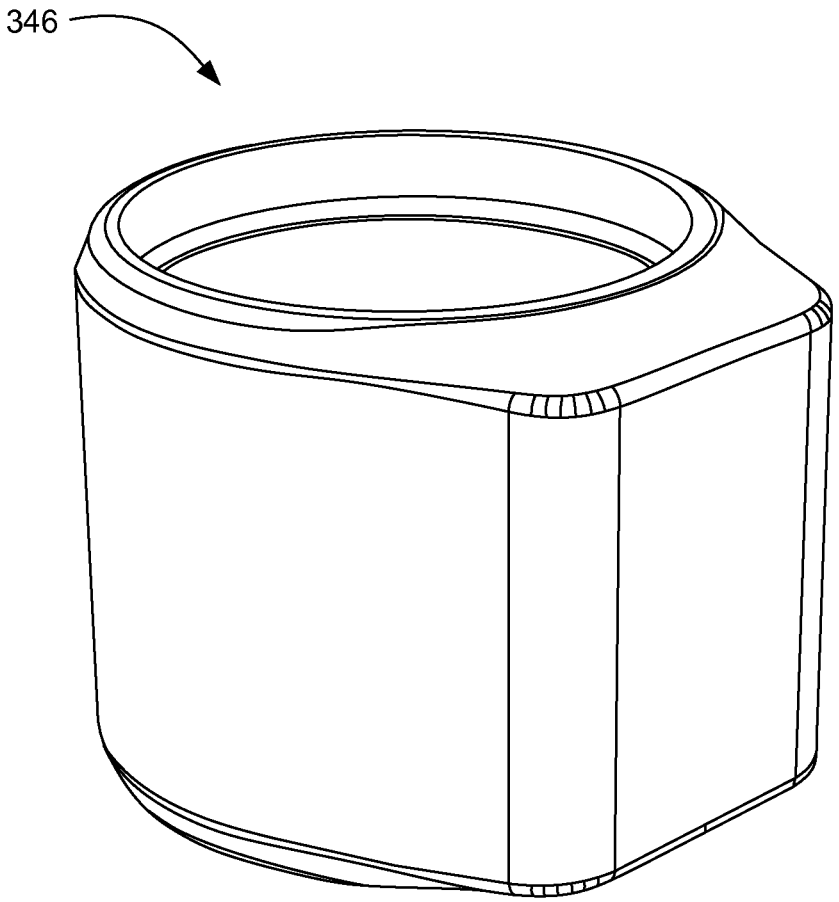
FIG. 10 is a perspective view of the clamp protector of the tee attachment of FIG. 6.

A pair of hose clamps 312 are provided to secure the tee attachment to the tee post. The clamps 312 are sized to fit into the clamp channels and can be tightened to securely hold the tee attachment in place on a tee post. Clamp protector 346 is arranged to slide over the tightened clamps to protect the clamps and the player's bat in the event that the batter strikes the tee attachment in that region during use. One suitable clamp protector 246 is illustrated in FIG. 10. In this embodiment, the clamp protector 246 is formed from vulcanized rubber and is arranged to be slid into place over the top of the main body 301.

The tee attachment may be attached to a tee in an "assembled" arrangement with the inner sleeve in place within the main body 301 and suitable moveable objects positioned within chamber 304. In such an approach, the slits in both the main body 301 and the inner sleeve 330 allow the tee attachment to be slid over the top of a batting tee post 150 as a unit such that the chamber 304 is supported at the top of the tee post 150. Clamps 312 are tightened to secure the tee attachment 300 to the tee post 150 and the clamp protector 346 is slid down over the hose clamps to protect the clamps. Alternatively, if desired, the inner sleeve can be placed onto the tee post first, the moveable objects placed onto object support surface/floor 343 and thereafter the main body can be placed over the inner sleeve followed by the clamping. If it is desired to change or add additional objects to the chamber after some use, that can be done by either just taking off the main body 301 and changing/adding objects and reattaching the main body, or by detaching/dissembling the entire tee attachment and reassembling/reattaching after the change has been made.

Figure 11:
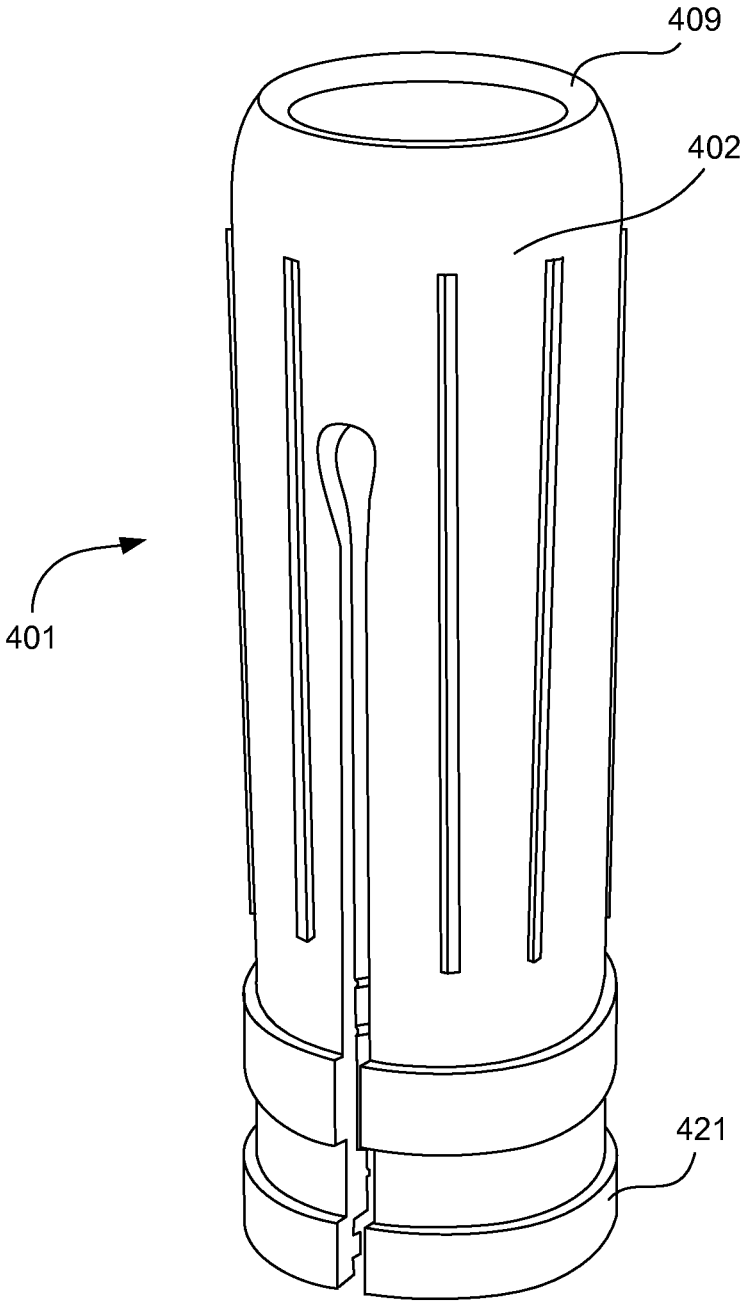
FIG. 11 is a perspective view of an alternative main body geometry.

Referring next to FIG. 11, yet another tee attachment main body 401 is illustrated. This embodiment is quite similar to the embodiment of FIG. 8 except that the geometry of some of the components vary somewhat. In this embodiment, the upper end of the main body does not taper in as much, and the main body walls adjacent the ball support 409 are substantially thicker than in the embodiment of FIG. 8, which provides added strength in the region of the ball support. This is helpful because the region of the main body adjacent the ball support is the region of the tee attachment that is most likely to be struck by a bat during use.

In other respects, the main body may be substantially the same as the previously described embodiment. For example, in the illustrated embodiment, main body 401 also has a pair of slits 415, ribs 417 and a pair of recessed clamp support surfaces 423, 424. The upper clamp support surface 423 is located between the bottom ends of ribs 417 and a boss 425. The lower clamp support surface 424 is located between the boss 425 and bottom flange 421. The recessed clamp support surfaces serve as clamp support channels that are sized appropriately to receive hose clamps 312. The inner surface of sleeve 402 includes a pair of substantially annular ribs positioned adjacent the clamp support surfaces that are arranged to engage corresponding annular grooves on the inner sleeve to help hold the main body 401 and the inner sleeve in place relative to one another. The bottom end of the sleeve 402 includes flange 421 on its outer surface and a stepped recess 427 on its inner surface that receives the lower inner sleeve flange. A substantially annular ridge 436 extends radially inward from within the recess 427. Of course, in alternative embodiments, the interlocking geometries between any of the described main bodies and their corresponding inner sleeves may be widely varied or even eliminated. By way of example, more or less rib/groove structures can be provided and/or their positions within the main body and/or sleeve may be move; ridges can be provided on the inner sleeve to mate with corresponding grooves in the main body; the geometry of the interlocking features can vary; etc.

Figure 12:
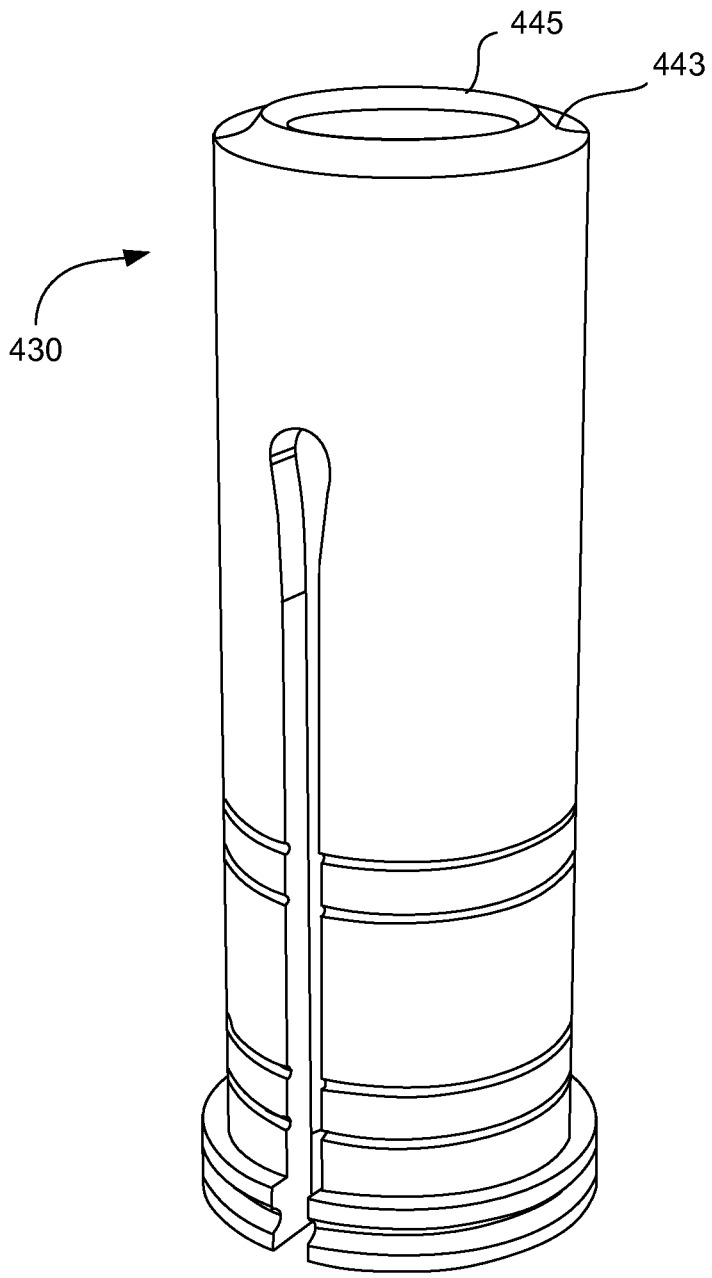
FIG. 12 is a perspective view of an alternative inner sleeve embodiment having an alternative floor protrusion layout.
Figure 13:
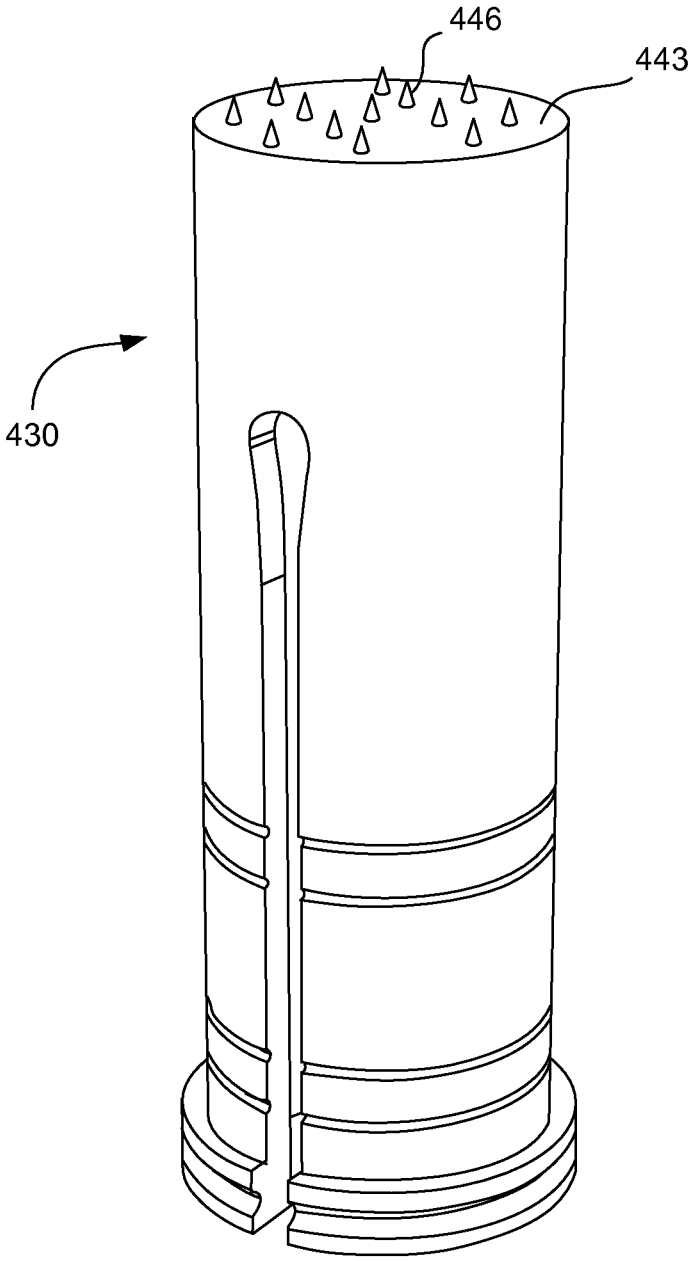
FIG. 13 is a perspective view of another alternative inner sleeve embodiment having yet another floor protrusion layout.

FIGS. 12 and 13 illustrate a couple alternative inner sleeve arrangements. These inner sleeve embodiments are quite similar to the embodiment of FIG. 9 except that the top end surface 443 of the sleeve that serves as the chamber floor has different motion enhancing features. In the embodiment of FIG. 12, a single annular ridge 445 is provided on the chamber floor/top sleeve surface 443 to help alter the motion of the moveable objects. In the embodiment of FIG. 13, a multiplicity of small projections 446 extend upward from the chamber floor/top sleeve surface 443 to help alter the motion of the moveable objects. Of course, a wide variety of other sleeve and/or floor geometries can be used as well.

In some circumstances it may be desirable to make some portions of the ball support and/or chamber walls opaque or to cover portions of the same during drills so that the moveable objects must be viewed from specific angle. This can be useful because it may be desirable to position the tee at different locations relative to the batter to facilitate simulation of different types of hitting situations and the windows may assist in reinforcing proper swing mechanics by making it more difficult to identify the objects when proper swing mechanics are not used.

Figure 16:
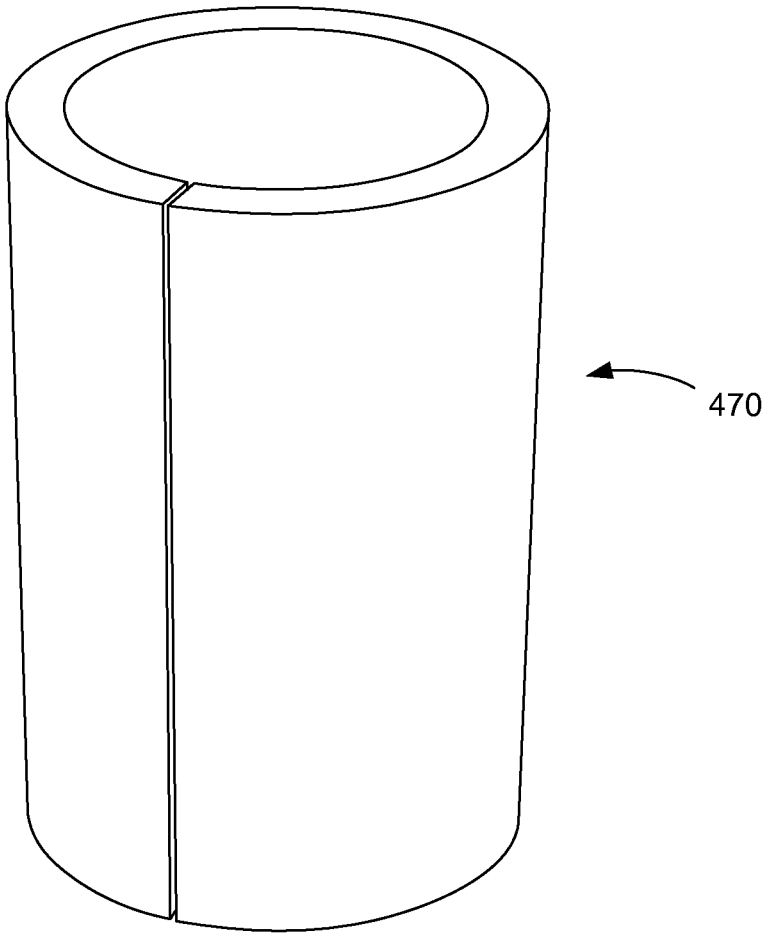
FIG. 16 is a perspective view showing a tee insert suitable for use in conjunction with certain small diameter tees.

There are some tees that have very narrow shafts. To accommodate attachment of the swing training device to such tees, a rubber insert, such as insert 470 illustrated in FIG. 16 can be placed over the tee shaft so that the device can be securely fastened to the tee over the insert.

The embodiments described above take the form of tee attachments that are designed to be secured to the post portion of a conventional batting tee. However, it should be apparent that in alternative embodiments, similar structures can be built into the tee itself, a tee post, or other similar structures. It should also be apparent that the geometry and construction of the chamber that holds the object(s), the nature and/or design of the moveable object(s), etc. can all be widely varied without departing from the spirit or scope of the invention. As previously mentioned, the main body and the inner sleeve may be formed from a variety of different materials. In some particular embodiments, the main body is formed from a clear hard urethane having a durometer of approximately 70 and the inner sleeve is formed from vulcanized rubber having a durometer of approximately 50.

A number of alternative designs are shown in U.S. Provisional Patent Application No. 61/942,173, filed Feb. 20, 2014, which is incorporated herein by reference.

Although only a few embodiments of the invention have been described in detail, it should be appreciated that the invention may be implemented in many other forms without departing from the spirit or scope of the invention. Therefore, the present embodiments should be considered illustrative and not restrictive and the invention is not to be limited to the details given herein, but may be modified within the scope and equivalents of the appended claims.

What is claimed is:

1. A swing training device arranged to be placed on a tee post and to support an independent ball to be struck, the device comprising:

an outer member including a ball support surface and an outer sleeve that extends downward from the ball support surface, the ball support surface being arranged to support a ball to be struck;

an inner member having an object support surface and an inner sleeve that extends downward from the object support surface, the outer member being positioned over the inner member such that the ball support surface is positioned above and spaced apart from the object support surface in a manner that defines a chamber in a region between the ball support surface and the object support surface, the object support surface serving as a chamber floor and being arranged to support at least one moveable object; and at least one moveable object positioned within the chamber, the moveable object being arranged such that when a ball positioned on the ball support surface is struck, the moveable object will potentially move its position or orientation within the chamber;

wherein at least a portion of the main body is substantially transparent such that a hitter using the swing training device can see the at least one moveable object inside the chamber when the hitter is looking at a point of contact where the ball was struck immediately after the ball is struck and displaced from the ball support surface.

2. A swing training device as recited in claim 1 wherein:

the inner sleeve includes a plurality of substantially vertically extending inner sleeve slots that open at a bottom end of the inner sleeve to facilitate placing the inner sleeve over a tee post;

the outer sleeve includes a plurality of substantially vertically extending outer sleeve slots that open at a bottom end of the outer sleeve to facilitate placing the outer sleeve over the inner sleeve;

at least one clamp arranged to secure the swing training device to the tee post; and a clamp cover arranged to cover the at least one clamp.

3. A swing training device as recited in claim 1 wherein the moveable objects have a geometry selected from the group consisting of:

disk shaped;

coin shaped;

a substantially regular polyhedron; and a substantially cubic die.

4. A swing training device as recited in claim 1 wherein the chamber floor includes at least one structure arranged to enhance rotational movement of the moveable object, the at least one structure being selected from the group consisting of:

an annular ring or ridge formed in the floor;

at least one ridge extending upward from the object support surface;

a plurality of projections extending upward from the floor; and a plurality of concentric rings.

5. A swing training device as recited in claim 4 wherein:

the at least one clamp includes first and second hose clamps, each hose clamp having an associated band;

the outer sleeve includes a pair of spaced apart substantially annular clamp grooves, each clamp groove being arranged to receive an associated one of the hose clamps; and the clamp cover is arranged to cover and protect the first and second hose clamps and a region between the first and second clamp grooves.

6. A swing training device as recited in claim 1 further comprising:

a set of interlocking structures formed on a radial inner surface of the outer sleeve; and a second set of complementary locking structure formed on a radially outer surface of the inner sleeve, the interlocking structures and complementary locking structures being arranged to engage one another when the swing training device is assembled and mounted to help prevent slipping of the main body relative to the inner sleeve during use of the swing training device; and wherein the interlocking structures and complementary locking structures include mating projections and recesses.

7. A swing training device arranged to support a ball to be struck, the device comprising:

a chamber having a floor, a wall and a ball support surface, the ball support surface positioned above and spaced apart from the floor and being arranged to support a ball to be struck, and wherein at least a portion of the wall and the ball support surface are substantially transparent such that a hitter using the swing training device can see inside the chamber; and at least one moveable object positioned within the chamber, the moveable object being arranged such that when a ball positioned on the ball support surface is struck, the moveable object will potentially move its position or orientation within the chamber, wherein the moveable object is arranged such that it can be seen by a hitter after the ball is struck when the hitter is looking at a point of contact where the ball is struck;

a sleeve that extends downward from the chamber, the sleeve being arranged to be placed over a tee post and having at least two substantially vertically extending slots that open at a bottom end of the sleeve, wherein the sleeve further includes a flange at a bottom end of the sleeve, and a substantially annular clamp groove, wherein the flange defines a bottom side of the clamp groove;

a clamp arranged to secure the sleeve directly or indirectly to the tee post, the clamp being arranged to be received in the clamp groove; and wherein the sleeve, the chamber wall and the ball support surface are formed as an integral unit.

8. A swing training device as recited in claim 7 further comprising an inward facing annular groove at a junction between the sleeve and the chamber wall, wherein the floor fits into the inward facing annular groove.

9. A swing training device as recited in claim 7 wherein the floor has a plurality of structures arranged to enhance flipping movement of the moveable object.

10. A swing training device arranged to support a ball to be struck, the device comprising:

an inner member arranged to be placed on a tee post, the inner member including a substantially tubular inner sleeve and a first end section integrally formed with the inner sleeve at a top end of the inner sleeve, the inner sleeve including a plurality of substantially vertically extending inner sleeve slots that open at a bottom end of the inner sleeve to facilitate placing the inner sleeve over a tee post; and an outer member arranged to be placed over the inner sleeve, the outer member including a substantially tubular outer sleeve including a second end section that includes a ball support surface;

a chamber defined between the first and second end sections and bounded by a portion of the outer sleeve, wherein at least a portion of the outer member is substantially transparent such that a hitter using the swing training device can see inside the chamber;

at least one moveable object positioned within the chamber, the moveable object being arranged such that when a ball positioned on the ball support surface is struck, the moveable object will potentially move its position or orientation within the chamber, wherein the moveable object is arranged such that it can be seen by a hitter after the ball is struck when the hitter is looking at a point of contact where the ball is struck;

at least one clamp arranged to secure the swing training device to the tee post; and a clamp cover arranged to cover the at least one clamp; and wherein the chamber floor includes at least one structure arranged to enhance flipping movement of the moveable object after the ball is struck.

* * * * *